US005570880A

United States Patent [19]

Nordgran

[11] Patent Number: 5,570,880

[45] Date of Patent: Nov. 5, 1996

[54] SUPPORT ARM FOR A BASKETBALL BACKBOARD

[75] Inventor: Richard C. Nordgran, Roy, Utah

[73] Assignee: Lifetime Products, Inc., Clearfield, Utah

[21] Appl. No.: 380,874

[22] Filed: Jan. 30, 1995

[51] Int. Cl.[6] ..... A63B 63/08

[52] U.S. Cl. ..... 273/1.5 R; 52/731.3; 52/732.2; 248/300; 248/218.4; 403/345; 403/363; 403/364

[58] Field of Search ..... 273/1.5 R, 1.5 A; 248/544, 300, 218.4–219.4, 230; 403/331, 335–340, 363, 364, 345; 52/730.4, 730.5, 731.2, 731.3–731.5, 732.1, 732.2, 732.3

[56] References Cited

U.S. PATENT DOCUMENTS

| | | | |
|---|---|---|---|
| 9,552 | 1/1853 | Bell | 403/364 |
| 70,383 | 10/1867 | Wilmot . | |
| 1,728,964 | 9/1929 | Gross . | |
| 1,947,392 | 2/1934 | Guntermann et al. | 248/30 |
| 2,583,043 | 1/1951 | Roy et al. | 24/111.5 |
| 3,134,468 | 5/1964 | Toti et al. | 52/731.3 |
| 3,728,837 | 4/1973 | Kiefer, Jr. | 52/732.2 |
| 3,776,549 | 12/1973 | Ganis | 273/1.5 R |
| 4,183,522 | 1/1980 | Killen | 273/1.5 R |
| 4,218,058 | 8/1980 | Hilbert et al. | 273/1.5 R |
| 5,006,386 | 4/1991 | Menichini | 52/732.2 X |
| 5,088,672 | 2/1992 | Neuendorf et al. | 248/230 |
| 5,470,054 | 11/1995 | Bohrman | 273/1.5 R |

FOREIGN PATENT DOCUMENTS

| | | | |
|---|---|---|---|
| 124231 | 5/1947 | Australia | 52/732.3 |
| 2258502 | 8/1975 | France | 52/731.2 |
| 7432 | of 1911 | United Kingdom | 52/732.3 |
| 520656 | 10/1939 | United Kingdom | 273/1.5 R |

OTHER PUBLICATIONS

Harvard 1988 Sporting Goods Catalog, "B9025 Easy–Adjuster Pole," p. 8, (1988).

Harvard, "Easy–Adjuster Adustable Basketball Pole," Owners Manual, pp. 1–8, (date unknown).

Diversified Products Corporation, "The Unbeatables!," *The Sporting Goods Dealer*, p. 61 (Jun. 1975).

*Primary Examiner*—Paul E. Shapiro

*Attorney, Agent, or Firm*—Madson & Metcalf

[57] ABSTRACT

A support arm for attaching a basketball backboard to a pole is disclosed. The support arm includes two support members configured with flanges extending generally along a longitudinal axis of the support arm. The flanges have a toothed configuration in the shape of a square wave which includes a plurality of tabs and recesses. The support members are capable of mating engagement with each other wherein the tabs along each of the flanges of the first support member engage the corresponding recesses of the respective flanges of the second support member, thereby disposing engaged flanges at an angle with respect to each other. The support members are configured with a substantially C-shaped cross section. The support members are attached to each other with bolts, thereby eliminating the need for welding. Means are also provided attaching one end of the support arm to the basketball backboard and the other end to a pole.

28 Claims, 4 Drawing Sheets

SUPPORT ARM FOR A BASKETBALL BACKBOARD

BACKGROUND

1. The Field of the Invention

The present invention is related to a basketball backboard support. More particularly, the present invention is related to a fixed support arm which includes two interlocking members and means to secure one end of the support arm to a basketball backboard and the other end to a basketball pole.

2. Technical Background

Basketball standards, backboards, and poles have become increasingly popular to the public consumer. The days when basketball was confined to the gym or schoolyard have long since passed. Today, basketball equipment can be purchased at local retail stores and installed by consumers. For today's basketball equipment manufacturers to be successful in the local retail store market, basketball equipment must be easily stored and packaged, simple to assemble, and manufactured using the most cost-efficient materials and processes.

One factor contributing to retail success of a product is the space required to store the product. Most conventional basketball systems do not lend themselves to efficient packaging. They are packaged in large boxes which are bulky and cumbersome. This limits the amount of units that can be stored on retail store shelves.

One component of a basketball system which generally contributes to these packaging difficulties is the backboard support arm — the support which connects the backboard to the pole and enables the backboard to be positioned at a horizontal offset from the pole. Many conventional backboard support arms are made of large cylindrical or square tubing which cannot be collapsed or separated into smaller space-saving pieces. Many conventional support arms also have attachment brackets welded to their ends which make the product even more difficult to package.

Product success in the retail store market also requires ease of product assembly by the consumer. Many conventional backboard support arms have multiple parts with complex instructions that are difficult to assemble. Still other conventional support arms have orientation dependent pieces which contribute to assembly error.

Basketball equipment such as backboard support arms must be available at a reasonable price. Many conventional backboard support arms are manufactured with costly materials using costly manufacturing processes. For example, prefabricated metal tubing is commonly used in the manufacture of backboard support arms. In an attempt to avoid the use of expensive tubing, some support arms are made of sheet metal which must then be welded to form a square tube or other configuration capable of withstanding the required forces.

Often, additional manufacturing processes are also employed in making support arms, such as drilling numerous holes to accommodate attachment linkages. Of course, each additional step in the manufacturing process results in a corresponding increase in the cost of the final product.

From the foregoing, it will be appreciated that it would be an advancement in the art to provide a backboard support arm which, in a preassembled state, has a smaller cross sectional dimension than the assembled support arm, thereby allowing it to be packaged in a smaller container than conventional one-piece support arms.

It would be an additional advancement in the art if such a support arm could be manufactured using a minimal number of steps, thereby keeping to a minimum the manufacturing costs.

Indeed, it would also be an advancement in the art if manufacture of such a support arm could be accomplished by merely stamping parts out of sheet metal while avoiding attachment by welding, thereby avoiding the use of expensive prefabricated tubing and the need for additional manufacturing steps to drill holes for attachment linkages.

It would be a further advancement in the art if the pieces that make up the support arm could be easily assembled by a consumer.

Such a backboard support arm is disclosed and claimed herein.

BRIEF SUMMARY OF THE INVENTION

The present invention is directed to a novel fixed support arm for a basketball backboard. The support arm includes two interlocking support members. Each support member has two flanges which extend generally along the longitudinal axis of the support arm. The flanges are configured with a plurality of tabs and recesses in a toothed configuration. The tabs along one flange of one support member are capable of engaging the recesses of a corresponding flange of the other support member in mating engagement.

In a preferred embodiment, the cross section of each support member, taken perpendicular to the flanges, is substantially C shaped. The flanges of each support member extend in an inward direction such that when two support members engage each other, an interior is defined with the tabs of the engaged flanges extending into the interior of the support arm. The support members are preferably configured such that the angle of disposition between two flanges in mating engagement is about 90 degrees.

The toothed configuration of the flanges is generally in the shape of a square wave. In a preferred embodiment, each tab on the flanges includes two sides which are canted in an inward direction at about a 20 degree angle. This helps facilitate engagement of the tab with its corresponding recess.

The support members are configured to be secured together without the use of welding. In a preferred embodiment, the support members are each configured at their ends with mounting holes which align when the support members are assembled in mating engagement. Bolts may be inserted through the mounting holes and secured with nuts to attach the support members to each other, thereby forming a rigid support arm.

The ends of each support member are angled to accommodate the angular disposition of the support arm with respect to the backboard and the pole. The support arm also includes a pair of side brackets for attachment to a pole. Each side bracket is configured with a pole engagement section and an attachment flange positioned on each side of the pole engagement section. The attachment flanges include holes through which mounting bolts may be inserted. Advantageously, the same bolts used to secure the support members to each other may also be used to secure the side brackets to the support members and to the pole.

Attachment linkages for securing the support arm to the basketball backboard may also be provided. Such linkages may attach to the same bolts which are used to secure the backboard end of the support members together.

Thus, it is an object of the present invention to provide a basketball backboard support arm which, in a preassembled state, has a smaller cross sectional dimension than the assembled support arm, thereby allowing it to be packaged in a smaller container than conventional one-piece support arms.

It is a further object of the present invention to provide such a support arm which can be manufactured using a minimal number of steps, thereby keeping to a minimum the manufacturing costs.

It is an additional object of the present invention to provide such a support arm which can be manufactured by merely stamping parts out of sheet metal while avoiding attachment by welding, thereby avoiding the use of expensive prefabricated tubing and the need for additional manufacturing steps to drill holes for attachment linkages.

It is also an object of the present invention to provide a support arm which can easily be assembled by a consumer.

These and other objects and advantages of the present invention will become more fully apparent by examination of the following description of the preferred embodiments and the accompanying drawings.

BRIEF DESCRIPTION OF THE DRAWINGS

A more particular description of the invention briefly described above will be rendered by reference to the appended drawings. Understanding that these drawings only provide information concerning typical embodiments of the invention and are not therefore to be considered limiting of its scope, the invention will be described and explained with additional specificity and detail through the use of the accompanying drawings, in which.

DETAILED DESCRIPTION OF THE PREFERRED EMBODIMENTS

Figure 1:
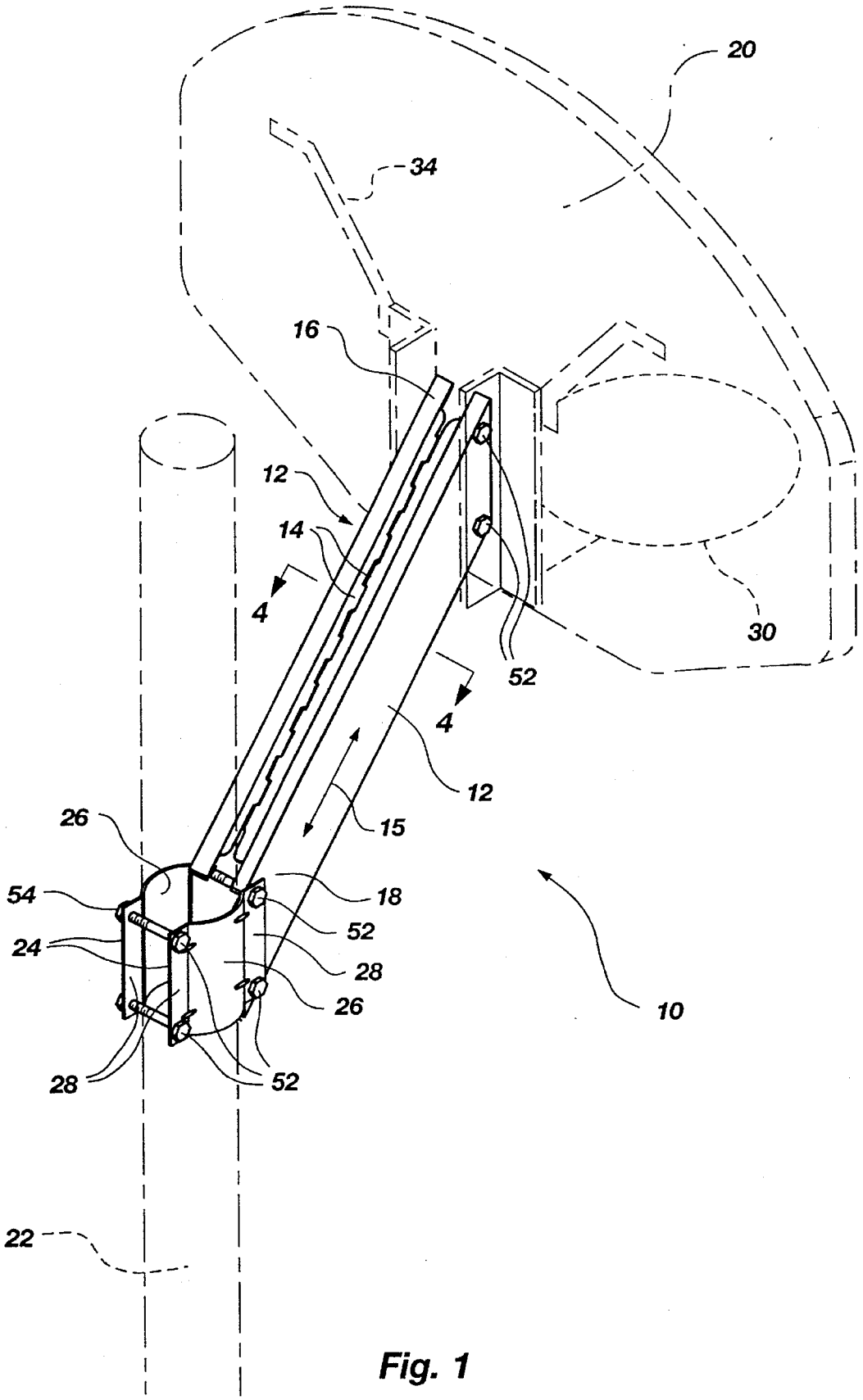
FIG. 1 is a perspective view of one embodiment of the fixed arm support attached to a basketball backboard and pole.

Reference is now made to the figures wherein like parts are referred to by like numerals throughout. With particular reference to FIG. 1, a backboard support arm according to the present invention is generally designated at 10.

The support arm 10 includes a plurality of support members 12. In the preferred embodiment illustrated in FIG. 1, the support arm 10 includes two support members 12. It will be appreciated that a support arm having more than two support members could be used to practice the teachings of this invention. For example, the support arm could be of triangular shape, having three support members 12.

With continued reference to FIG. 1, each support member 12 has two flanges 14 extending generally along a longitudinal axis 15 of the support arm 10. The support arm 10 has a first end 16 and a second end 18. The first end 16 is configured for attachment to a basketball backboard 20. The second end 18 is configured for attachment to a pole 22 by means of a pair of side brackets 24.

Each side bracket 24 is configured with a pole engagement section 26 and an attachment flange 28 positioned on each side of the pole engagement section 26. It will be appreciated that a variety a differently shaped brackets 24 may used to secure the support arm 10 to the pole 22. These might include a single end plate affixed to the second end 18 of the support arm 10. It will also be appreciated that the first end 16 and second end 18 of the preferred embodiment of the support arm are interchangeable, thereby making the assembly of the unit simpler.

Figure 2:
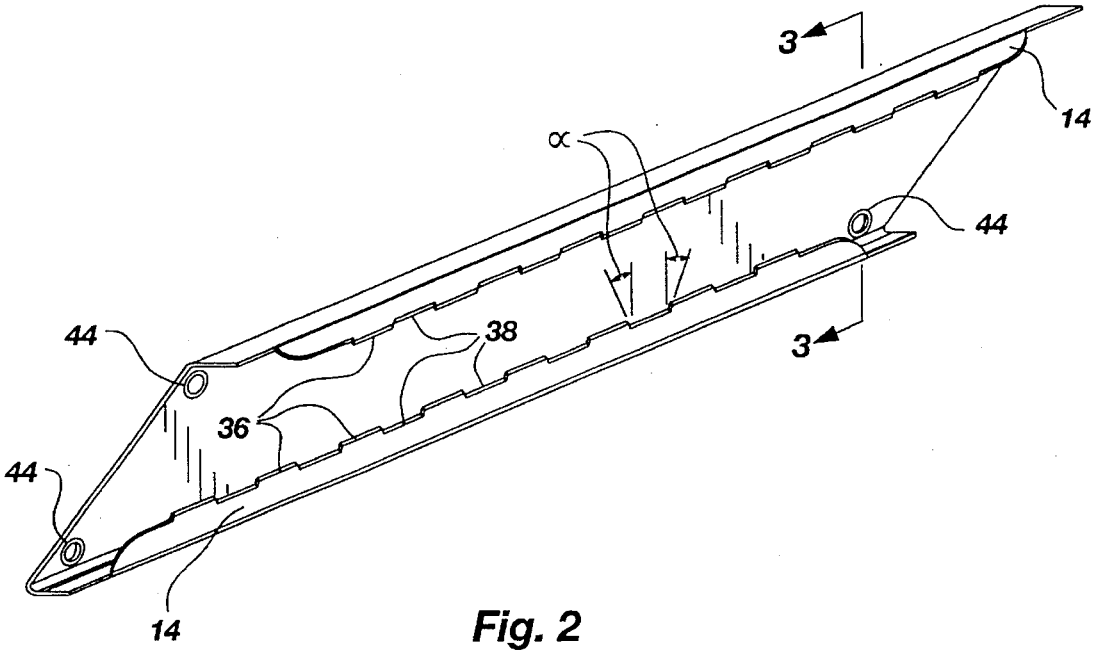
FIG. 2 is a perspective view of one embodiment of the support member of the fixed arm support of FIG. 1.

With reference now to FIG. 2, each flange 14 of each support member 12 has a toothed configuration comprising a plurality of tabs 36 and recesses 38 which permit the support members to matingly engage each other. The toothed configuration of the flanges in this preferred embodiment is generally in the shape of a square wave, although it will be appreciated by one of skill in the art that a variety of toothed configurations may be employed to effectively allow the support members 12 to interlock with each other.

The toothed pattern on each flange 14 is substantially identical in shape. Each support arm 10 of the preferred embodiment is configured such that when the support arms are oriented for mating engagement, it makes no difference which of the two flanges 14 of one support arm 12 engages a flange 14 of the other support arm 12. This orientation independency increases the ease of assembly for the consumer.

With continued reference to FIG. 2, each tab 36 of each flange 14 includes two sides 40 which are canted towards each other at an angle $\alpha$ to facilitate engagement with a corresponding recess 38. The angle $\alpha$ with which the sides 40 of the tabs 36 are canted is preferably between about 10 and about 3 degrees. In one presently preferred embodiment, the angle $\alpha$ is about 20 degrees. The canted tabs 36 also increase the ease of assembly for the consumer.

As illustrated in the preferred embodiment of FIG. 2, each support member 12 is configured with a pair of mounting holes 44 at each end. The holes accommodate the attachment of the support members 12 to each other and are employed in attaching the first end 16 of the support arm 10 to a backboard 20 (as shown in FIG. 1) and in attaching the second end 18 of the support arm to a pole 22 (also shown in FIG. 1). It will be appreciated that a varying number of holes in various locations may be used to facilitate the attachment of the support members 12 to each other and to accommodate the attachment of the support arm 10 to the backboard 20 and to the pole 22.

While a number of methods, including drilling, may be employed to configure the mounting holes 44 into the support members 12, the preferred method is to simply stamp the support member 12 out of a flat sheet of metal. By using a properly configured die, the support member may be completely formed in this single process. This process increases the cost efficiency of manufacture by eliminating the need for drilling or multiple cutting.

Figure 3:
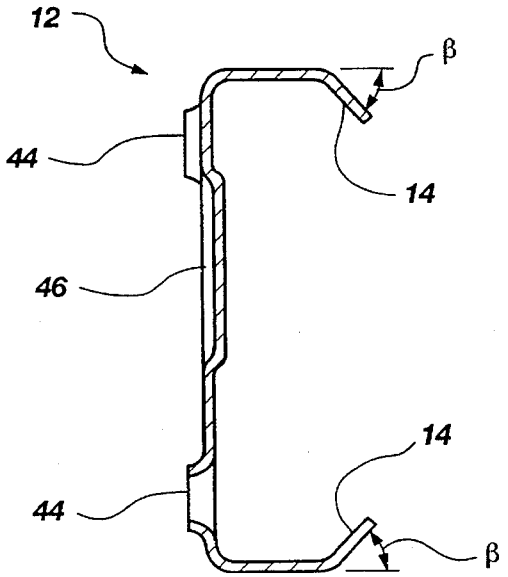
FIG. 3 is a cutaway side plan view of the support member of FIG. 2.

With reference now to FIG. 3, the cross section of each support member 12, taken perpendicular to the longitudinal axis of the support arm 10, is illustrated. In this preferred embodiment, the support members 12 are configured with a cross section which is substantially C shaped. The flanges 14 preferably extend inwardly at an angle $\beta$ which is between about 20 and about 70 degrees. The flanges 14 of the preferred embodiment of FIG. 3 extend towards each other at an angle $\beta$ of about 45 degrees.

The support members 12 are further configured with reinforcement channels 46 to add strength to the support arm as is known in the art.

Figure 4:
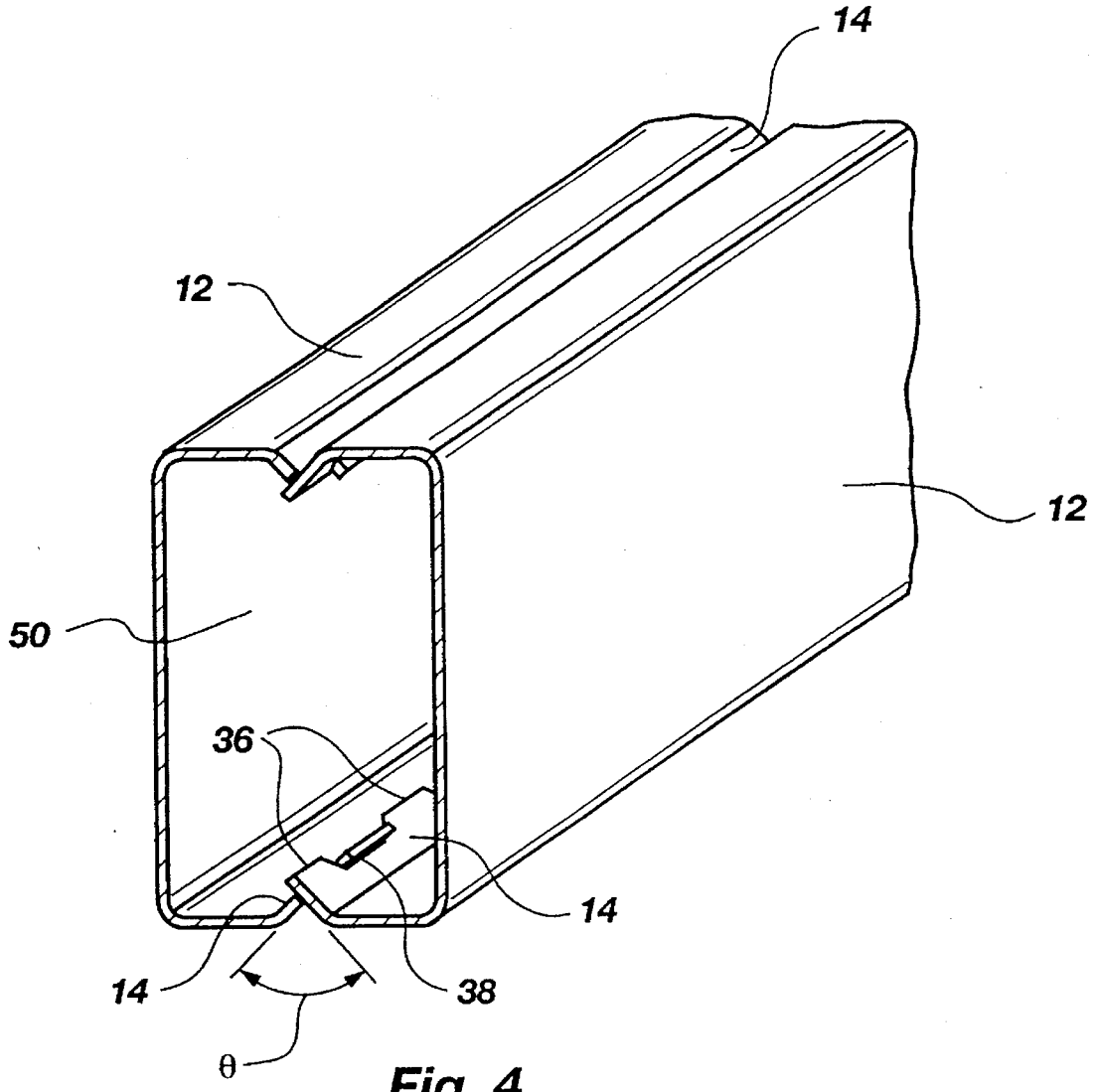
FIG. 4 is cutaway perspective view of two support members of the fixed arm support of FIG. 1 in mating engagement.

With reference now to FIGS. 3 and 4, the flanges 14 of each support member 12 extend in an inward direction such that when two support members 12 are placed in mating engagement, the tabs 36 extend into an interior 50 of the support arm 10.

As can best be seen in FIG. 4, when two support members 12 are placed in mating engagement, the tabs 36 along at least one flange 14 engage the recesses 38 of a flange of the corresponding support member 12. The flanges 14 thus engage each other at an angle Θ, which is generally between about 45 and about 135 degrees, and is preferably about 90 degrees. The interlocking configuration of the flanges 14 provides the strength of a single-piece support arm 10. Support arm 10 of the present invention, however, offers the advantage of the support arm 10 being detachable into smaller pieces. As illustrated in FIGS. 3 and 4, the support members 12 are configured with a smaller cross sectional dimension than the support arm 10. The support arm can, thus, be packaged in an unassembled state in a smaller package, thereby enhancing the marketability of the item.

Figure 5:
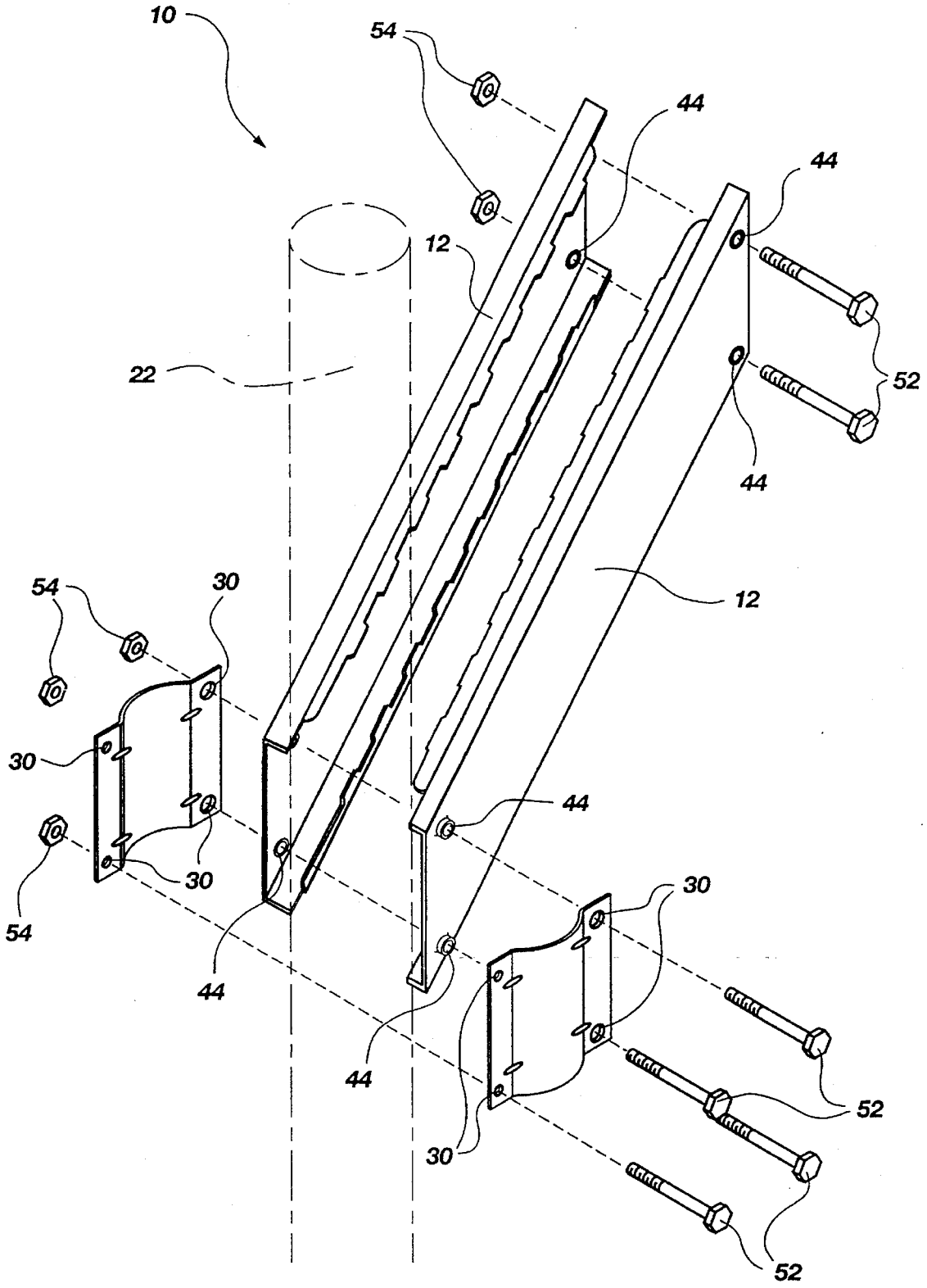
FIG. 5 is a perspective exploded view of the fixed arm support of FIG. 1.

FIG. 5 illustrates how the support members 12 are secured together without having to employ welding. A plurality of bolts 52 which may extend through the mounting holes 44 on each support member 12 are employed. In the preferred embodiment of FIG. 5, a pair of bolts at each end of the support arm 10 are used. Each bolt 52 is threaded to receive a nut 54, such that the support members 12 may be releasably secured together by fastening the nut 54 to the bolt 52.

Of course, one of skill in the art will appreciate that a variety of methods may be employed in securing the support members 12 together. The ability to eliminate welding from the manufacturing process makes for more cost efficient manufacturing. The ability to package the support arm in two separate pieces also allows the unit to be packaged more efficiently. However, it will be appreciated that under some circumstances, it may be advantageous to permanently secure the support members together with a weld.

FIG. 5 also illustrates one presently preferred means of attaching the support arm 10 to the basketball pole 22. The attachment flanges 28 of the side brackets 24 adjacent the support arm have holes 30 configured in them to receive the bolts 52 used to secure the support members together. By positioning the bolts 52 within both the mounting holes 44 and the flange holes 30 adjacent the support arm, the support arm may be simultaneously attached to the side brackets 24. The attachment flanges 28 of the side brackets 24 which are positioned away from the support arm 10 also have holes 30 configured to receive bolts 52. With the pole engagement section 26 positioned about the pole 22, the support arm 10 may be attached to the pole 22 by means of securing nuts 54 to the bolts 52 positioned through the side brackets 24 and the support arm 10.

With reference again to FIG. 1, the first end 16 and the second end 18 of the support arm 10 are configured at an angle with respect to the longitudinal axis 15 of the support arm 10. This configuration of the preferred embodiment allows the angular disposition of the support arm with respect to the basketball backboard 20 and the pole 22 and permits the backboard 20 to be mounted at a height which is above the end of the pole 22.

FIG. 1 illustrates a basketball system of use in playing the game of basketball. The basketball system comprises the basketball backboard 20, a goal 30 attached to the basketball backboard 10, a pole 22, and attached to the support arm 10 attached to the backboard 20 at the first end 16 and the pole 22 at the second end 18.

FIGS. 1 and 5 illustrate how to use the basketball system including the support arm of the present invention. The user first combines the support members 12 together in mating engagement to form the support arm 10. The user may then secure the support arm to the conventional hardware 34 of the backboard 20. The user, while manually maintaining the support members 12 in mating engagement with each other, positions bolts 52 through the backboard hardware 34 and through the mounting holes 44 in the second end 16 of the support arm 10. By securing nuts to the bolts, the backboard 20 is attached to the support arm 10 and the support members 12 are secured together at the first end 16 of the support arm. The user then positions bolts 52 within the flange holes 30 of the side brackets 24 and within the mounting holes 44 of the second end 18 of the support arm 10. By securing nuts to the bolts 52, the support arm 10 is attached to the side brackets 24 and the support members 12 are further secured to each other. With the pole engagement section 26 of the side brackets 24 positioned about the pole 22, the support arm 10 may be attached to the pole 22 by securing nuts to the bolts positioned within the side brackets 24.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A support arm for attaching a basketball backboard to a pole, comprising:

a plurality of support members, each support member having two flanges extending generally along a longitudinal axis of the support arm, the flanges having a toothed configuration comprising a plurality of tabs and recesses, the support members capable of mating engagement with each other wherein the tabs along at least one flange of a first support member engage the recesses of a flange of a second support member, thereby disposing engaged flanges at an angle with respect to each other;

means for securing the support members together in mating engagement;

means for attaching a first end of the support arm to the basketball backboard; and means for attaching a second end of the support arm to the pole.

2. A support arm as defined in claim 1, wherein the plurality of support members comprise two support members.

3. A support arm as defined in claim 1, wherein the cross section of each support member, taken perpendicular to the longitudinal axis of the support arm, is substantially C shaped.

4. A support arm as defined in claim 3, wherein the flanges of each support member extend in an inward direction such that when two support members engage each other, an interior is defined with the tabs of the engaged flanges extending into the interior of the support arm.

5. A support arm as defined in claim 1, wherein the support members are configured such that the angle of disposition between two flanges in mating engagement is between about 45 and about 135 degrees.

6. A support arm as defined in claim 1, wherein the toothed configuration of the flanges is generally in the shape of a square wave.

7. A support arm as defined in claim 1, wherein the toothed pattern on each flange is substantially identical in shape.

8. A support arm as defined in claim 1, wherein each support member is made by stamping it out of a flat sheet of metal.

9. A support arm as defined in claim 1, wherein the support members are configured to be secured together without the use of welding.

10. A support arm as defined in claim 1, wherein the support members are configured with a smaller cross sectional dimension than the support arm.

11. A support arm for attaching a basketball backboard to a pole, comprising:

a first and second support member, each support member having two flanges extending generally along a longitudinal axis of the support arm, the flanges having a toothed configuration generally in the shape of a square wave, the toothed configuration comprising a plurality of tabs and recesses, the support members capable of mating engagement with each other wherein the tabs along each of the flanges of the first support member engage the corresponding recesses of the respective flanges of the second support member, thereby disposing engaged flanges at an angle with respect to each other, the support members having a cross section, taken perpendicular to the longitudinal axis of the support arm, which is substantially C shaped;

means for securing the support members together in mating engagement without the use of welding;

means for attaching a first end of the support arm to the basketball backboard; and means for attaching a second end of the support arm to the pole.

12. A support arm as defined in claim 11, wherein the flanges of each support member extend in an inward direction such that when two support members engage each other, an interior is defined with the tabs of the engaged flanges extending into the interior of the support arm.

13. A support arm as defined in claim 11, wherein the support members are configured such that the angle of disposition between two flanges in mating engagement is between about 45 and about 135 degrees.

14. A support arm as defined in claim 13, wherein the support members are configured such that the angle of disposition between two flanges in mating engagement is about 90 degrees.

15. A support arm as defined in claim 11, wherein each tab on the flanges includes two sides which are canted towards each other to facilitate engagement with a corresponding recess.

16. A support arm as defined in claim 15, wherein the angle with which the sides of the tabs are canted is between about 10 and about 30 degrees.

17. A support arm as defined in claim 16, wherein the angle with which the sides of the tabs are canted is about 20 degrees.

18. A support arm as defined in claim 11, wherein the toothed pattern on each flange is substantially identical in shape.

19. A support arm as defined in claim 11, wherein each support member is configured with mounting holes and wherein the means for securing the support members together comprises a plurality of bolts configured to extend through a mounting hole on each support member and a nut corresponding to each bolt.

20. A support arm as defined in claim 11, wherein the means for attaching a second end of the support arm to the pole comprises a pair of side brackets, each side bracket configured with a pole engagement section and an attachment flange positioned on each side of the pole engagement section, the attachment flanges including holes through which mounting bolts may be inserted.

21. A support arm as defined in claim 11, wherein the first end and the second end of the support arm are configured at an angle with respect to the longitudinal axis of the support arm to thereby accommodate the angular disposition of the support arm with respect to the basketball backboard and the pole.

22. A basketball system for use in playing the game of basketball, comprising:

a basketball backboard;

a goal which may be attached to the basketball backboard;

a pole;

a support arm for attaching the basketball backboard to the pole, the support arm comprising a first and second support member, each support member having two flanges extending generally along a longitudinal axis of the support arm, the flanges having a toothed configuration generally in the shape of a square wave, the toothed configuration comprising a plurality of tabs and recesses, the support members capable of mating engagement with each other wherein the tabs along each of the flanges of the first support member engage the corresponding recesses of the respective flanges of the second support member, thereby disposing engaged flanges at an angle with respect to each other of between about 45 and about 135 degrees, the support members having a cross section, taken perpendicular to the longitudinal axis of the support arm, which is substantially C shaped, the support members configured with mounting holes for use in securing the support members to each other; and a bolt configured to extend through mounting holes on corresponding support members and a nut corresponding to each bolt;

means for attaching a first end of the support arm to the basketball backboard; and a pair of side brackets for attaching a second end of the support arm to the pole, each side bracket configured with a pole engagement section and an attachment flange positioned on each side of the pole engagement section, the attachment flanges including holes through which mounting bolts may be inserted.

23. A basketball system as defined in claim 22, wherein the first end and the second end of the support arm are configured at an angle with respect to the longitudinal axis of the support arm to thereby accommodate the angular disposition of the support arm with respect to the basketball backboard and the pole.

24. A basketball system as defined in claim 22, wherein the flanges of each support member extend in an inward direction such that when two support members engage each other, an interior is defined with the tabs of the engaged flanges extending into the interior of the support arm.

25. A basketball system as defined in claim 22, wherein the support members are configured such that the angle of disposition between two flanges in mating engagement is about 90 degrees.

26. A basketball system as defined in claim 22, wherein each tab on the flanges includes two sides which are canted towards each other to facilitate engagement with a corresponding recess.

27. A basketball system as defined in claim 26, wherein the angle with which the sides of the tabs are canted is between about 10 and about 30 degrees.

28. A basketball system as defined in claim 27, wherein the angle with which the sides of the tabs are canted is about 20 degrees.

* * * * *